US005560171A

United States Patent [19]

McCoy

[11] Patent Number: 5,560,171

[45] Date of Patent: Oct. 1, 1996

[54] STACKABLE CONSTRUCTION BLOCKS

[76] Inventor: John R. McCoy, 28 Woodbridge Circle, Ashburn, Ontario, Canada, L0B 1A0

[21] Appl. No.: 253,125

[22] Filed: Jun. 2, 1994

[51] Int. Cl.[6] ..... E04B 1/04; E02D 27/32

[52] U.S. Cl. ..... 52/592.6; 52/297; 52/299; 52/604; 52/608

[58] Field of Search ..... 52/293.2, 296, 52/299, 604, 605, 608, 297, 592.1, 592.6

[56] References Cited

U.S. PATENT DOCUMENTS

| | | | |
|---|---|---|---|
| 221,127 | 10/1879 | Walker | 52/592.6 |
| 364,427 | 6/1887 | McCallip . | |
| 2,129,211 | 9/1938 | Hickl . | |
| 2,141,035 | 12/1938 | Daniels | 52/604 |
| 3,505,764 | 4/1970 | Gutierrez . | |
| 4,110,949 | 9/1978 | Cambiuzzi et al. | 52/605 |
| 4,328,651 | 5/1982 | Gutierrez . | |
| 5,122,015 | 6/1992 | Shen | 52/592.6 |

FOREIGN PATENT DOCUMENTS

| | | | |
|---|---|---|---|
| 153630 | 4/1951 | Australia | 52/592.6 |
| 66941 | 9/1971 | Canada . | |
| 50411 | 10/1982 | Canada . | |
| 51904 | 10/1983 | Canada . | |
| 61629 | 9/1988 | Canada . | |
| 64468 | 10/1989 | Canada . | |
| 1297260 | 3/1992 | Canada . | |
| 71265 | 8/1992 | Canada . | |
| 1308930 | 10/1992 | Canada . | |
| 946337 | 5/1949 | France . | |
| 2917148 | 6/1980 | Germany . | |
| 3014523 | 10/1981 | Germany . | |

*Primary Examiner*—Michael Safavi

*Attorney, Agent, or Firm*—Finnegan, Henderson, Farabow, Garrett & Dunner

[57] ABSTRACT

Stackable construction blocks include generally parallel first and second faces and recess means on said first face including a central socket adapted to receive and support the end of a post and a channel means adapted to receive and support the end of a beam, and on the second face one or more channels adapted to receive and support a portion of a beam.

9 Claims, 1 Drawing Sheet

STACKABLE CONSTRUCTION BLOCKS

BACKGROUND OF THE INVENTION

The present invention relates to building stackable construction blocks adapted to receive and support horizonal and vertical building elements.

Construction devices adapted to receive and support vertical posts and/or horizontal beams are known. For instance, in U.S. Pat. No. 4,328,651, a building element is disclosed which is adapted to receive the ends of horizontal beams, the ends of the beams being adapted to form a base to support a vertical post. However, the construction element disclosed lacks versatility since it is necessary to utilize horizontal beams if a vertical beam is to be supported.

Two different construction devices for connecting building elements are disclosed in Canadian patents 1,297,260 and 1,308,930. One device is a concrete block having a rectangular central recess and channels on an upper face thereof, the former being adapted to support a vertical post and the latter being adapted to support the end or a portion of a horizontal beam. However, the concrete block is formed in the shape of a truncated pyramid and lacks flexibility since it is not adapted to be stacked to allow for height requirements of the vertical and horizontal building elements, or support of horizontal elements at varying vertical heights.

SUMMARY OF THE INVENTION

The present invent ion provides stackable construction blocks, each comprising, (a) a body having defining sides between a first and a second face; and (b) recess means including, (i) on said first face, a central socket adapted to receive and support the end of a post, and one or more first channels extending from one defining side to said central socket adapted to receive and support the end of a beam; and (ii) on said second face, one or more second channels extending from one defining side to an opposing defining side adapted to receive a portion of a beam.

The present invention also provides stackable construction blocks as described further including protrusions and indentations on at least one of the first and second faces and wherein the protrusions are arranged and adapted to be fully receivable within indentations or recesses on an adjacent face of an adjacent construction block when the construction blocks are stacked. The protrusions are preferably sized such that when two or more protrusions are received in two or more corresponding indentations, adjacent stacked building elements are prevented from relative angular rotation by engagement of the protrusions against the indentations upon relative angular force being applied to said building elements. Further, the protrusions and indentations may be arranged to allow for varying predetermined angular orientations between said first and second channels.

The construction blocks of the present invention may be used singularly, or in stacked configuration. Stacking allows for a multiplicity of possible orientations and heights of central sockets and channels. Further, the construction blocks may themselves be supported on a vertical post or on a base. When stacked it is possible to support a lower construction block on a vertical post with an upper construction block having said first face directed upwardly such that it may receive and support an additional vertical post. Similarly, when stacked, a lower construction block may receive and be supported on a horizontal beam, and intermediate construction blocks in the stack may receive and support horizontal beams at varying heights and relative angular rotations, while an upper construction block in the stack may receive and support either a vertical post or a horizontal beam.

Generally, the provision of recess means on two parallel faces of the stackable construction blocks and the arrangement of protrusions and indentations to allow for stacking of the elements in predetermined relative angular relationships provides a flexible means for supporting and/or connecting vertically and/or horizontally oriented building elements in a manner not heretofore available.

The present invention provides construction blocks which may be used singularly or in conjunction with other similar blocks to support vertical posts and horizontal beams at various heights above supporting building elements or bases (which may be the ground in appropriate circumstances) upon which the construction blocks are themselves supported.

BRIEF DESCRIPTION OF THE DRAWINGS

The present invention will now be described, by way of example, in connection with the accompanying drawings in which.

DETAILED DESCRIPTION

Figure 1:
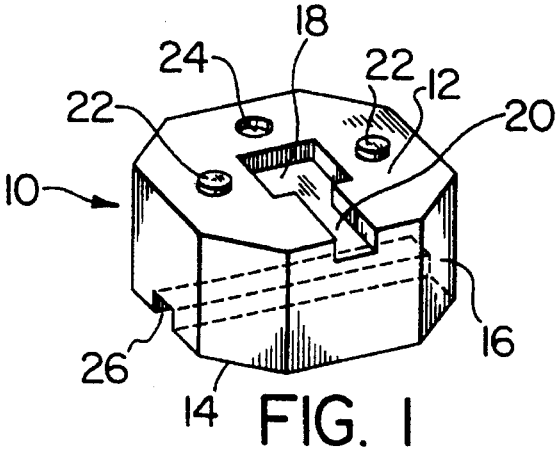
FIG. 1 is a perspective view of one embodiment of the construction blocks of the invention.

Referring to FIG. 1, a first embodiment of the present invention comprises a block generally designated 10 having a right octagonal body comprising a first face 12 and a generally parallel second face 14. Defining sides 16, which are generally perpendicular to the plain of said first and second faces 12, 14, extend between the first and second faces 12, 14. The block described may be concrete, or any suitable material or composite material. The type of material will depend upon the strength and durability necessitated by the application to which the construction block 10 will be subjected. Similarly, with respect to shape of the construction block 10, any number of geometrical shapes may be utilized so long as the first and second faces 12, 14 are generally parallel and the defining sides 16 are generally perpendicular to the faces 12, 14.

Figure 5:
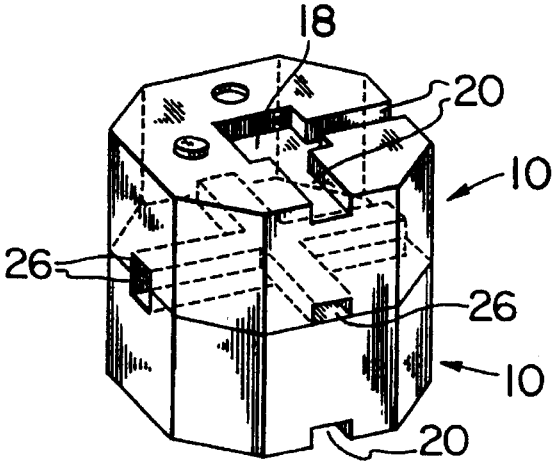
FIG. 5 is a perspective view of a stack of a second embodiment of the construction blocks of the invention.

The construction blocks 10 include a central socket 18 and first channel means 20 extending from one defining side 16 to the central socket 18 on the first face 12. While the building element is shown with only a single channel 20 extending from a defining side 16 to the central socket 18, additional channels may be included which extend from other defining sides to the central recess 18. The number of channels 20 will depend upon the application to which the construction block will be put. For instance, if it is necessary to support the ends of two horizontal beams and a vertical post additional channels 20 will be required as shown in FIG. 5 which is described below.

Protrusions 22 and indentations 24 of like shape are present on the first face 12.

Figure 2:
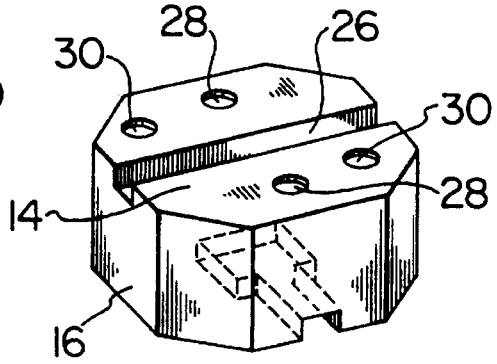
FIG. 2 is a second perspective view of the embodiment of FIG. 1.

Recess means comprising a channel 26 extending from one defining side 16 to an opposing defining side 16 are provided on said second face as clearly shown in FIG. 2. In the embodiment described indentations 28 and 30 are included on said second face of the construction block.

With respect to the protrusions 22 and indentations 24, 28, 30, it is not necessary that the shape of the protrusions and indentations be disc like as shown. However, preferably, the indentations are the same general shape as the protrusions but slightly oversized to facilitate receipt of the protrusions 22 in the indentations 24, 28, 30 on adjacent construction blocks when the blocks are stacked. Similarly, the precise shape of the central socket 18 and any of the channel means 20, 26, while shown as rectangular on the figures, are not limited to that shape and may be any suitable shape for receiving and supporting the particular building elements which are to be supported. Further, the number of indentations and on protrusions or the faces 12, 14 may vary so long as adjacent stacked blocks may be stacked with opposing faces flush.

Figure 3:
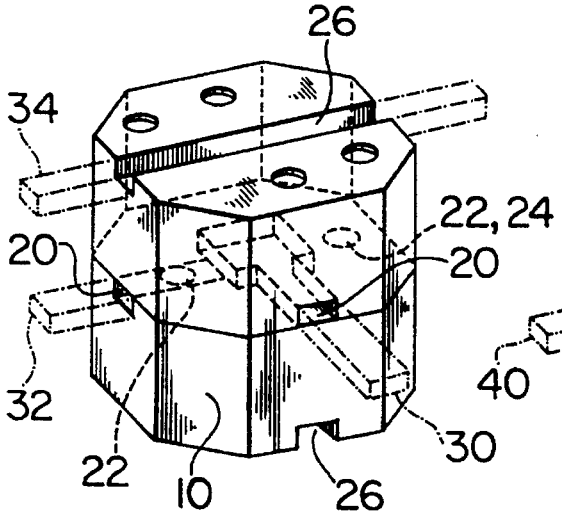
FIGS. 3 and 4 are perspective views of stacks of the construction blocks shown in FIGS. 1 and 2 in two different arrangements.

In use, construction blocks of the configuration shown in FIGS. 1 and 2 may be stacked in various manners. For instance, the blocks could be stacked with first faces 12 adjacent as shown in FIG. 3 in that case one of the protrusions 22 would be received in the indentation 24 and the second protrusion 22 would be received in the channel 20. Accordingly, the channels 20 and 26 of each block would be aligned generally perpendicular to the corresponding channels 20, 26 on the adjacent construction block 10. Further, the stacked construction blocks would be adapted to support and hold the ends of two horizontal beams 30, 32 at right angles, one at the height of the channel 20 in the lower construction block, and the second perpendicular beam at the height of the first face of the lower construction block 10. A portion of a horizontal beam 34 may also be supported in the recess 26 of the upper construction block.

Figure 4:
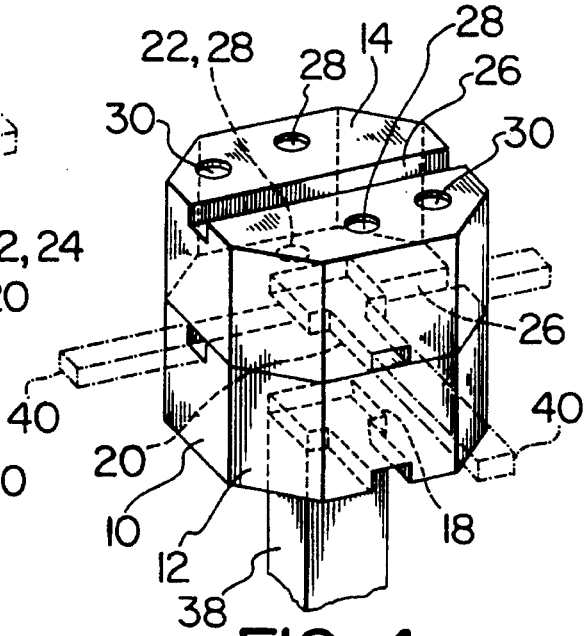

Similarly, the construction blocks may be stacked with the first face 12 of one block adjacent the second face 14 of a second block as shown in FIG. 4. In that case, the protrusions 22 may be received in the channel 26, the indentations 28, or the indentations 30. Accordingly, it is possible to achieve various relative angular orientations between the channels 20, 26 on the respective construction blocks 10. In FIG. 4, the protrusion 22 is received in indentation 28. The FIG. 4 configuration facilitates orientation of the uppermost construction block such that the central socket 18 is directed upwardly and adapted to receive and support the end of a vertical post. Similarly, as shown in FIG. 4, the central socket 18 of the lower construction block 10 may be oriented downwardly thereby facilitating support of the stacked building elements on a vertical post 38 if desired. Horizontal beams 40 may be supported in channels 20, 26 as shown.

Referring to FIG. 5, an alternate embodiment of the invention including two channels 20 and two channels 26 on the construction blocks 10 is disclosed. In the figure, two blocks 10 are stacked with second faces adjacent. As apparent from the figure, numerous horizontal beams may be supported on the stack of construction blocks, and a vertical beam may be supported on the central socket 18 of the upper construction block 10.

A particularly advantageous application of the construction blocks of the invention is for building decks. Variation between vertical post lengths may be minimized by stacking the construction blocks. Further, the construction blocks 10 may be oriented such that horizontal beams may be run between stacks of construction blocks 10 at intermediate heights thereby facilitating completion of the facing of the deck. While some ground preparation will be necessary to prepare a suitable base for bearing the weight of the blocks and the deck, excavation may be minimized since the blocks may be stacked to facilitate similar lengths of beams supported on adjacent blocks around the periphery of the deck.

Figure 6:
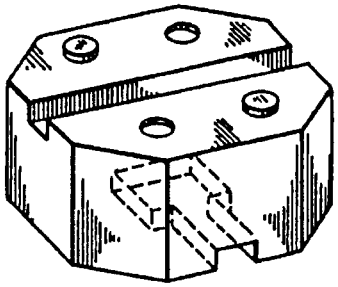
FIG. 6 is a perspective view of a third embodiment of the construction blocks of the invention.

As will be understood by those skilled in the construction arts, the exact configuration and placement of the various recess means, protrusions 28 and indentations 30 does not form an essential part of the invention. For instance, multiple channels 26 could be located at various angles on said second face 14. Similarly, it is possible to arrange the protrusions 28 and indentations 30 in numerous manners with protrusions located on only one side as in the examples shown, or alternatively, with protrusions on both sides, or on the opposite side to that shown or with multiple protrusions and multiple indentations on each side as shown in FIG. 6, the corresponding protrusions or indentations on the bottom of the Figure not being shown.

The exact placement of the various protrusions and indentations, as well as relative orientation of any channels will depend upon the application for which the building elements are required. Accordingly, the invention claimed is not limited by the detailed description herein, but is instead as set out in the claims appended hereto.

I claim:

1. Stackable construction blocks, each comprising:

(a) a body having generally parallel defining sides between generally parallel first and second faces;

(b) recess means including:

(i) on said first face, a central socket adapted to receive and support the end of a post, and a first channel extending from one defining side to said central socket adapted to receive and support the end of a beam; and (ii) on said second face, at least one second channel extending from one defining side to an opposing defining side adapted to receive and support a portion of a beam;

(c) two protrusions on said first face adjacent said central socket;

(d) an indentation on said first face aligned with said first channel adjacent said central socket;

(e) at least two indentations on said second face aligned at a predetermined angle relative to said second channel;

wherein said protrusions and indentations are of the same general shape with the indentations being slightly larger than the protrusions to facilitate receipt therein of protrusions on adjacent construction blocks, and wherein said protrusions and indentations are arranged on said stackable construction blocks such that the protrusions are fully receivable within indentations or recess means on the adjacent face of an adjacent construction block when the construction blocks are stacked.

2. Stackable construction blocks, each comprising:

(a) a body having generally parallel defining sides between generally parallel first and second faces, each of said sides having generally the same geometrical shape and size;

(b) recesses including:

(i) on said first face, a central socket defining a seat shaped to receive and support the end of a post, and at least one first channel extending from one defining side to said central socket, said first channel being shaped to receive and support the end of a beam; and (ii) on said second face, at least one second channel extending from one defining side to an opposing defining side of said second channel and being shaped to receive and support a portion of a beam;

(c) including on said first face two protrusions aligned adjacent said central socket and one indentation aligned with said first channel adjacent said central socket; and on said second face at least two indentations aligned at a predetermined angle relative to said second channel, said protrusions and indentations being arranged and having dimensions such that the protrusions are fully receivable within indentations or a recess on the adjacent face of an adjacent construction block when the construction blocks are stacked, said protrusions and indentations being of the same general shape but the indentations being slightly larger to facilitate receipt therein of protrusions on adjacent construction blocks.

3. Stackable construction blocks according to claim 2 wherein said protrusions and indentations are arranged such that at least two protrusions are received in indentations on an adjacent face of an adjacent construction block when the construction blocks are stacked.

4. Stackable construction blocks according to claim 3 wherein relative angular rotation between adjacent construction blocks is inhibited when the construction blocks are stacked by engagement of at least two protrusions in corresponding indentations.

5. Stackable construction blocks according to claim 2 wherein said protrusions and indentations are arranged to allow the construction blocks to be stacked with defining sides of respective construction blocks aligned and the first and second channels of the construction blocks at one or more predetermined relative angular orientation to the first and second channels of an adjacent construction block.

6. Stackable construction blocks, each comprising:

(a) a body having generally parallel defining sides between generally parallel first and second faces;

(b) recesses including:

(i) on said first face, a central socket defining a seat shaped to receive and support the end of a post, and at least one first channel extending from one defining side to said central socket, said first channel being shaped to receive and support the end of a beam, and (ii) on said second face, at least one second channel extending from one defining side to an opposing defining side of said second channel and being shaped to receive and support a portion of a beam;

(c) wherein said first face includes two protrusions aligned adjacent said central socket and one indentation aligned with said first channel adjacent said central socket; and wherein said second face includes at least two indentations aligned at a predetermined angle relative to said second channel, said protrusions and indentations being arranged and having dimensions such that the protrusions are fully receivable within an indentation or a recess on the adjacent face of an adjacent construction block to allow the construction blocks to be stacked with the first and second channels of adjacent blocks at more than one relative angular orientation with respect to each other;

wherein the protrusions and indentations are of the same general shape, but the indentations are slightly larger to facilitate receipt therein of protrusions on adjacent construction blocks.

7. Stackable construction blocks according to claim 6, wherein said protrusions and indentations are arranged such that at least two protrusions are received in two indentations on an adjacent face of an adjacent construction block when the construction blocks are stacked.

8. Stackable construction blocks according to claim 7, wherein relative angular rotation between adjacent construction blocks is inhibited when the construction blocks are stacked by engagement of at least two protrusions in corresponding indentations.

9. Stackable construction blocks according to claim 6 wherein said protrusions and indentations are arranged to allow the construction blocks to be stacked with defining sides of respective construction blocks aligned and the first and second channels of a construction block at more than one predetermined relative angular orientation with respect to the first and second channels of an adjacent construction block.

* * * * *